US011548179B2

(12) United States Patent
Ormaechea Saracibar et al.

(10) Patent No.: US 11,548,179 B2
(45) Date of Patent: Jan. 10, 2023

(54) CUTTER MODULE AND METHOD

(71) Applicant: HEWLETT-PACKARD DEVELOPMENT COMPANY, L.P., Spring, TX (US)

(72) Inventors: Joseba Ormaechea Saracibar, Sant Cugat del Valles (ES); Angel Gistas Perez, Sant Cugat del Valles (ES); Felix Ruiz Martinez, Sant Cugat del Valles (ES)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/603,554

(22) PCT Filed: Jul. 2, 2018

(86) PCT No.: PCT/US2018/040617
§ 371 (c)(1),
(2) Date: Oct. 7, 2019

(87) PCT Pub. No.: WO2020/009689
PCT Pub. Date: Jan. 9, 2020

(65) Prior Publication Data

US 2021/0331341 A1 Oct. 28, 2021

(51) Int. Cl.

| | |
|---|---|
| ***B26D 1/18*** | (2006.01) |
| ***B26D 7/26*** | (2006.01) |
| ***B41J 11/68*** | (2006.01) |
| ***B41J 11/70*** | (2006.01) |

(52) U.S. Cl.
CPC ..... *B26D 1/185* (2013.01); *B26D 7/2621* (2013.01); *B41J 11/68* (2013.01); *B41J 11/70* (2013.01)

(58) Field of Classification Search
CPC ..... B26D 1/185; B26D 7/2621; B41J 11/68; B41J 11/70
See application file for complete search history.

(56) References Cited

U.S. PATENT DOCUMENTS

| | | | | |
|---|---|---|---|---|
| 4,463,640 | A | 8/1984 | Cogswell et al. | |
| 5,980,140 | A | 11/1999 | Gutsell et al. | |
| 6,681,667 | B2 | 1/2004 | Kohda et al. | |
| 6,832,537 | B2 * | 12/2004 | Takabatake | B26D 1/0006 83/508 |
| 8,303,200 | B2 | 11/2012 | Yokoyama et al. | |
| 9,032,850 | B2 * | 5/2015 | Chiba | B26D 1/385 83/74 |
| 9,321,286 | B2 | 4/2016 | Bar-Tal et al. | |
| 10,792,829 | B2 * | 10/2020 | Sanz Ananos | B26D 1/14 |

(Continued)

FOREIGN PATENT DOCUMENTS

| | | |
|---|---|---|
| EP | 2903833 B1 | 8/2015 |
| JP | 2001088382 A | 4/2001 |

(Continued)

*Primary Examiner* — Omar Flores Sanchez

(57) ABSTRACT

A cutter arrangement for media processing equipment, including a cutter module to be arranged on a shaft via a dedicated one of a number of transmission devices, at least one of the cutter module and the transmission devices comprising a registration feature to guide a user to arrange the cutter module on the dedicated one of the number of transmission devices.

19 Claims, 7 Drawing Sheets

(56) References Cited

U.S. PATENT DOCUMENTS

| | | | | |
|---|---|---|---|---|
| 2013/0118330 | A1* | 5/2013 | Sago | B26D 7/08 83/596 |
| 2016/0303892 | A1* | 10/2016 | Killian | B26D 7/0006 |
| 2018/0311856 | A1* | 11/2018 | Ward | B31D 1/021 |
| 2018/0311979 | A1* | 11/2018 | Mistyurik | B65C 9/1803 |
| 2020/0095003 | A1* | 3/2020 | Mistyurik | B65C 9/1803 |
| 2020/0171691 | A1* | 6/2020 | Urrutia Nebreda | B26D 1/143 |
| 2020/0198379 | A1* | 6/2020 | Endo | B26D 1/245 |
| 2020/0238554 | A1* | 7/2020 | Barrer | B26D 5/086 |
| 2020/0353635 | A1* | 11/2020 | Urrutia Nebreda | B26D 1/205 |
| 2021/0039347 | A1* | 2/2021 | Pettersson | B65H 29/52 |

FOREIGN PATENT DOCUMENTS

| | | | |
|---|---|---|---|
| JP | 2001105383 | A | 4/2001 |
| RU | 2297333 | C2 | 4/2007 |
| WO | WO-2017188937 | A1 | 11/2017 |

* cited by examiner

CUTTER MODULE AND METHOD

BACKGROUND

Some printers include a cutting device which can cut a print medium before or after a printing operation. The cutting device may include a cutting blade supported on a carriage to move across a print zone. By movement of the carriage across the print zone and/or movement of the print medium along a media advance path through the print zone, the cutting blade may cut in one or two linear directions, such as the X (the direction of the movement of the carriage) and the Y direction (the direction of the media advance path).

BRIEF DESCRIPTION OF DRAWINGS

The following description references the drawings, wherein.

DETAILED DESCRIPTION

Figure 1:
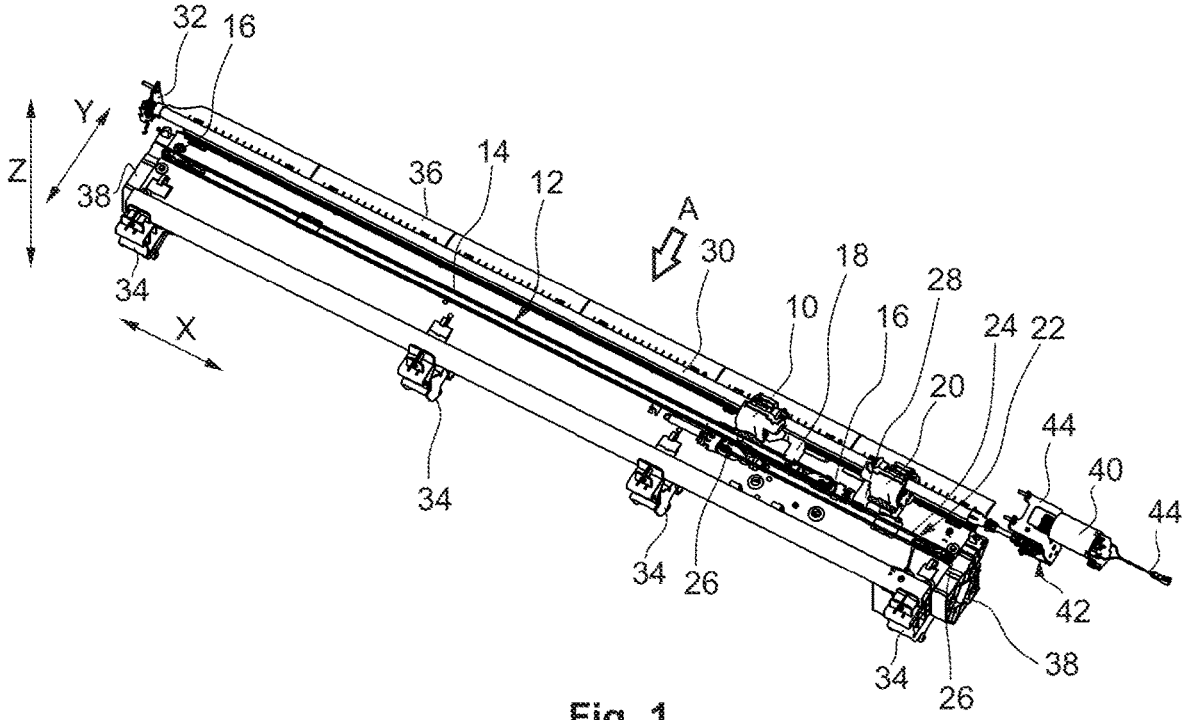
FIG. 1 shows a perspective view of a cutter arrangement according to an example.
Figure 2:
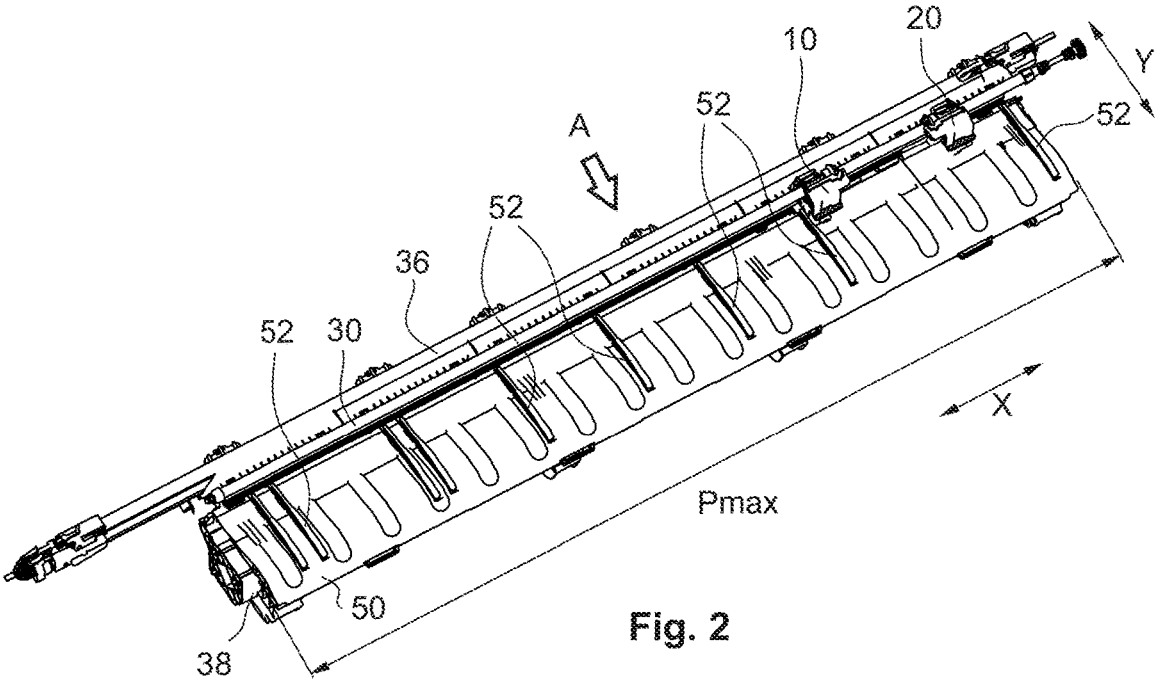
FIG. 2 shows another perspective view of the cutter arrangement of FIG. 1 in combination with printer parts according to an example.

FIGS. 1 and 2 provide an overview to illustrate a cutter arrangement using two cutter modules according to an example, in different perspective views.

In the illustrated example, the cutter arrangement comprises a first cutter module 10 and a second cutter module 20, which are discussed in further detail below. The first and second cutter modules 10, 20 are arranged on a shaft 30 extending in a direction perpendicular to a media advance direction A of a printer. The media advance direction A also is referred to as Y direction, and a carriage scanning direction, perpendicular to the Y direction, also is referred to as X direction. The direction of gravity, perpendicular to both the Y and X directions, may be designated as Z direction. The first cutter module 10 also can be designated as left-hand cutter module, and the second cutter module 20 also can be designated as right-hand cutter module, wherein left and right designates the position of the cutter module as seen from the front of the printer which, in this example, is the direction opposite to the media advance direction A. The two cutter modules may, at least in part, be mirror versions of each other.

The two cutter modules 10, 20 are arranged on the shaft 30 to be independently slidable along the length of the shaft 30, e.g., along the scanning direction X, wherein a sliding movement of the cutter modules 10, 20 can be caused by respective first and second pulley drives 12, 22 coupled to the first and second cutter modules 10, 20 via positioners 18, 28. This allows selectively positioning the two cutter modules 10, 20 at a right-hand edge and a left-hand edge of a cutting zone downstream of a print zone of the printer, for different cutting zones of varying width and position. In the illustrated example, a cutting zone of maximum width Pmax would extend about across the width of an output platen 50, illustrated in FIG. 2. Each pulley drive 12, 22 comprises a pulley belt 14, 24 and pulley wheels 16, 26 and drive units (not shown) for driving at least one of the pulley wheels 16, 26 of each pulley drive. A drive unit may comprise e.g. an electric motor.

In the illustrated example, pulley drive 22 associated with the second or right-hand cutter module 20 extends across about 30% of the maximum cutting zone width Pmax, at the right-hand side of the cutting zone, and pulley drive 12 associated with the first or left-hand cutter module 10 extends across about 80-90% of the maximum cutting zone width Pmax, at the left-hand side of the cutting zone. The belts 14, 24 of the first and second pulley drives 12, 22 overlap and, for example, can be designed in such a way that the first and second cutter modules 10, 20 can be positioned at any left-hand and right-hand margins of a print medium which the associate printer is able to print on in the print zone.

The first and second cutter modules 10, 20 are removably coupled to the first and second pulley belts 12, 24 by respective positioners 18, 28 to be engaged with the cutter modules 10, 20. Accordingly, when engaged with its associated positioner, movement of either one of the belts 14, 24 pulls the associated cutter module 10, 20 along the shaft 30 to position the cutter modules 10, 20 on two sides of an adjustable cutting zone, for example.

The shaft 30 is coupled to a drive motor 40 via a drive gear train 42, including a number of gears, for transmitting rotation of the drive motor 40 to the shaft 30. The drive motor 40 may be a servomotor, a BLDC motor or a stepping motor or another electric motor. The drive motor 40 may be supplied and driven via supply/drive lines 44 operatively coupled to a controller (not shown) of the printer, for example.

The cutter arrangement including the drive motor 40 may be mounted in a printer chassis (not shown) via a number of brackets and supports 32, 34, 36, 38, 44.

FIG. 2 illustrates an output platen 50 which may serve as support for a print medium which is transported through the printer and out of a print zone in the media advance direction A. The output platen 50 covers the pulley drives 12, 22 and partially covers the positioners 18, 28 to guide the print medium on a smooth surface of the output platen 50. The cutter modules 10, 20 will be arranged above the output platen. FIG. 2 further shows a number of retractable ribs 52 which are provided to support the print medium to stay flat and even when transported in the media advance direction A. A print media advance system (not shown) may be provided to transport the print medium through the print zone and across the output platen 50 in the media advance direction A. Further, a print cartridge carrying a printhead (not shown) may be arranged above the print zone upstream of the output platen 50 to deposit a printing fluid on the print medium within the print zone. The print cartridge or several print cartridges may be carried by a printer carriage which may be slidable along a bar or a shaft (not shown) parallel to shaft 30 and extending in a direction perpendicular to the media advance direction A. The carriage may carry an array of print cartridges containing printing fluids, e.g. four, MCYK, ink inkjet print cartridges. The printing fluid may be dispensed from the print cartridges and may be any fluid that can be dispensed by an inkjet-type printer or other inkjet-type dispenser and may include inks, varnishes, and/or post or pre-treatment agents, for example. The carriage scans across the print medium in the print zone while the print heads are selectively fired to generate a printed plot.

Figure 3:
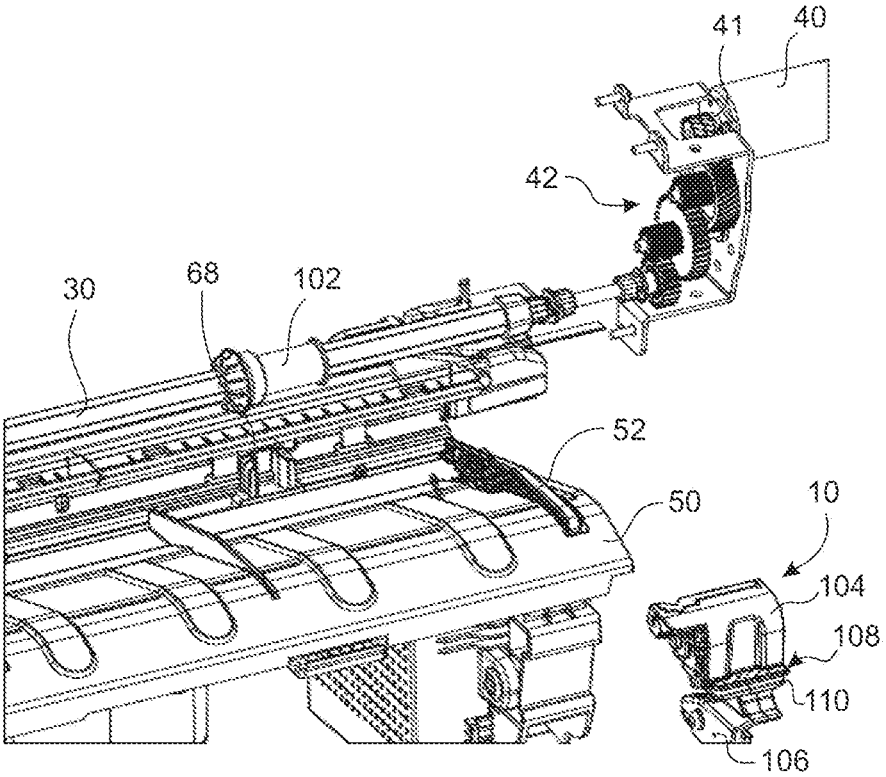
FIG. 3 shows a partial perspective view of part of the cutter arrangement of FIG. 2, with a cutter module unlatched and removed, according to an example.
Figure 4:
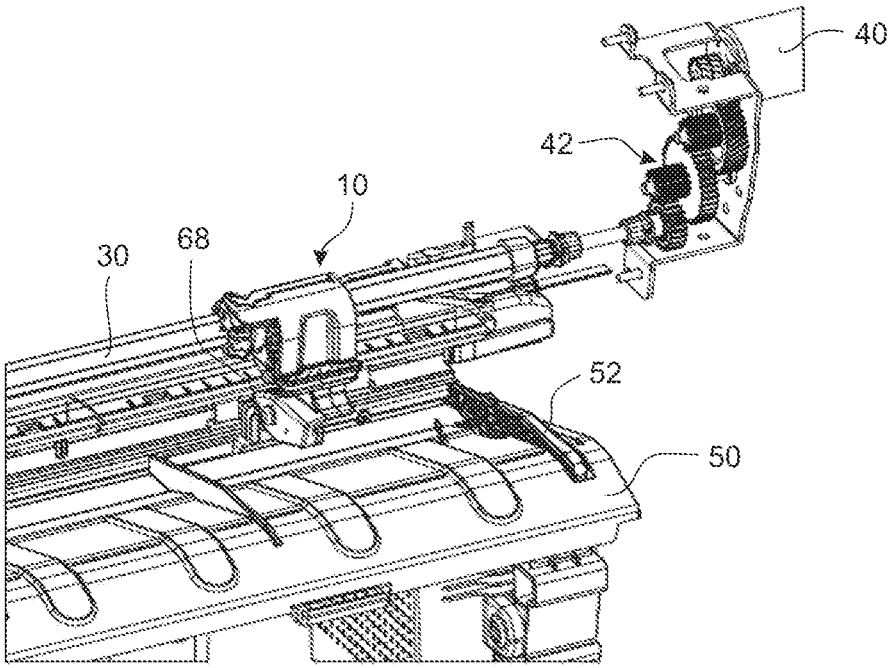
FIG. 4 shows a similar perspective view as FIG. 3, with the cutter module latched, according to an example.
Figure 5:
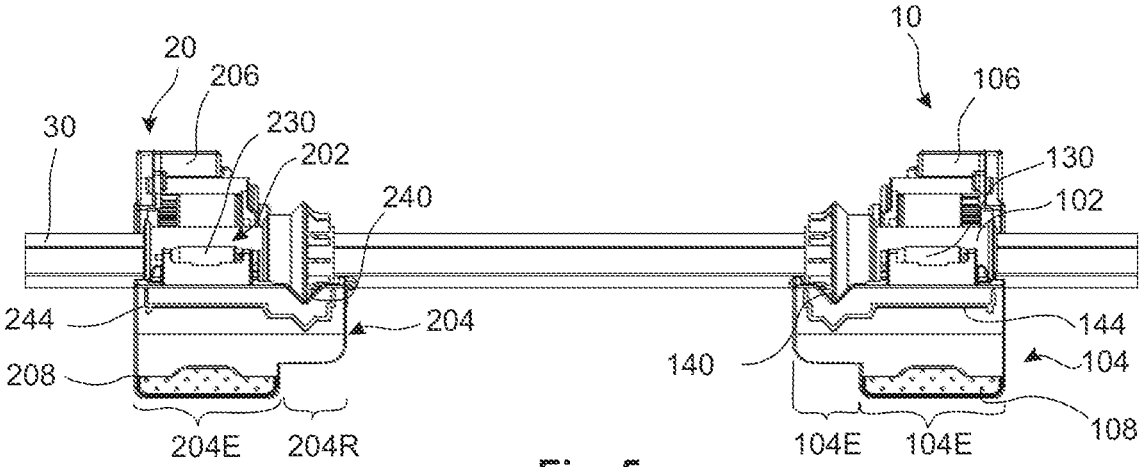
FIG. 5 shows a top view of part of the cutter arrangement including two cutter modules, according to an example.
Figure 6A:
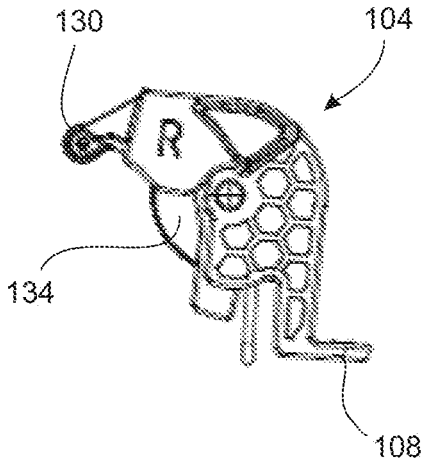
FIG. 6A shows a side view of a top half of a cutter module according to an example.
Figure 6B:
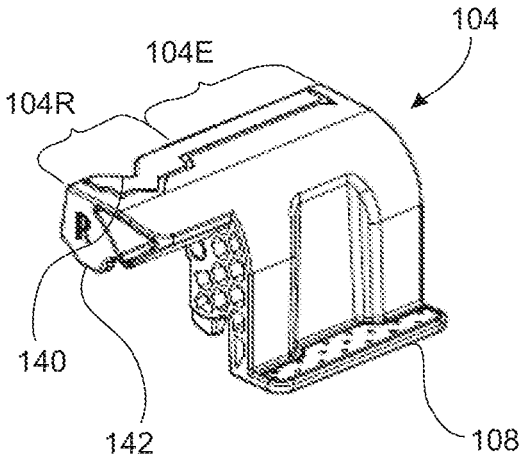
FIG. 6B shows a perspective view of the top half of the cutter module of FIG. 6A according to an example.
Figure 6C:
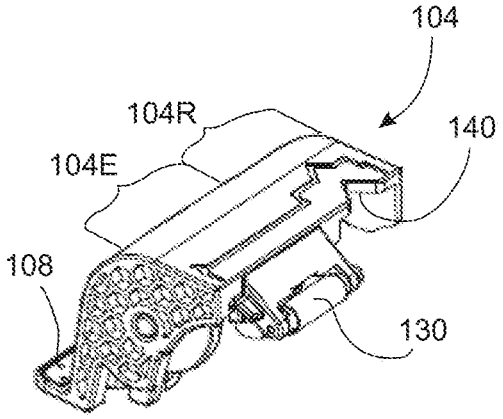
FIG. 6C shows another perspective view of the top half of the cutter module of FIG. 6A according to an example.
Figure 6D:
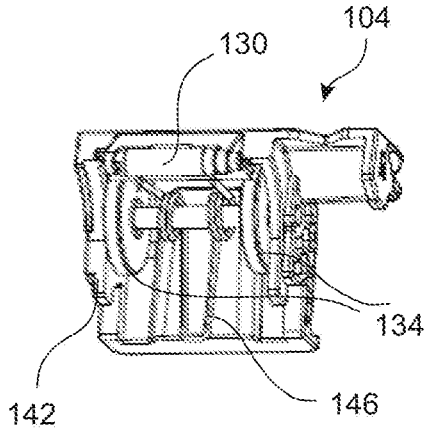
FIG. 6D shows another perspective view of the top half of the cutter module of FIG. 6A according to an example.
Figure 7:
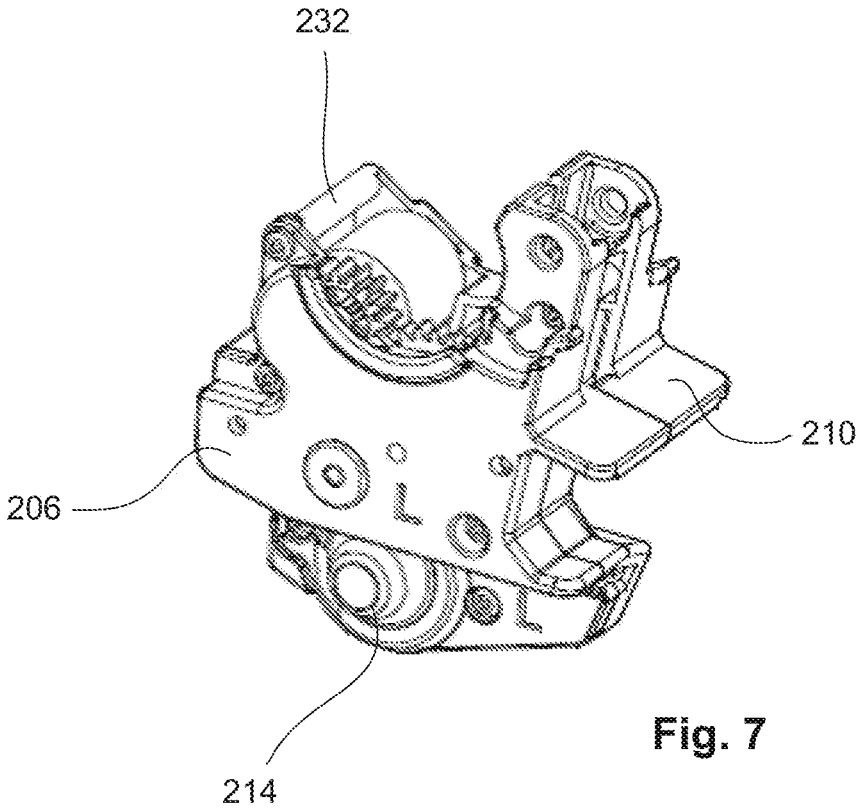
FIG. 7 shows a perspective view of a bottom half of a cutter module, according to an example.
Figure 8:
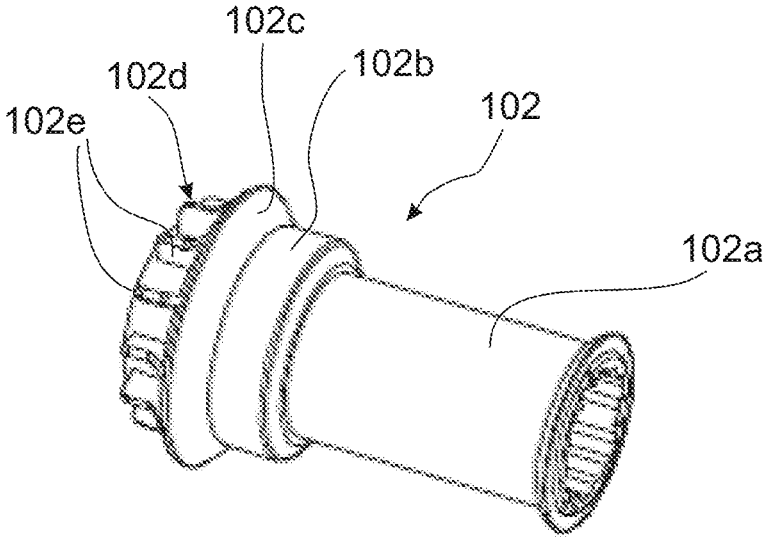
FIG. 8 shows a perspective view of a transmission ring, according to an example.

FIG. 3 to 9 show further details of the drive gear train 42, coupling the drive motor 40 to the shaft 30, of the cutter modules 10, 20, and of the coupling mechanism between the drive shaft 30 and the first and second cutter modules 10, 20, according to various examples. FIGS. 3 and 4 are perspective views of the cutter arrangement from the front and left-hand side; FIG. 5 is a top view on part of the cutter arrangement; FIGS. 6 and 7 show different perspective views of a top half and a bottom half of a cutter module; FIG. 8 shows a perspective view of a transmission ring; and FIGS. 9A and 9B show side views of a cutter module in a latching position and an unlatching position, respectively, according to various examples. The same or corresponding components as in the previous figures are designated by the same reference numbers.

In the illustrated example, the drive gear train 42 comprises a number of spur gears which, in the example, provide three transmission stages to transmit rotation of a toothed output shaft 41 of the drive motor 40 to shaft 30. The drive gear train 42 allows adjusting the rotation speed of the shaft 30 and transmits rotation of output shaft 41 in both a clockwise direction and a counterclockwise direction.

In the illustrated example, the shaft 30 has a polygonal cross-section, such as a hexagonal cross-section wherein other cross-sections, including a circular or noncircular, elliptic or a non-symmetrically shaped cross-section may be provided. The cutter modules 10, 20 are coupled to the shaft 30 by respective transmission rings 102, 202 of which the right-hand transmission ring 102 is shown in FIGS. 3 and 8. In the example, the transmission rings 102, 202 engage with the outer periphery of the shaft 30 in a formfitting manner wherein, alternatively or additionally, a press fit or engagement by additional fixing elements, such as a screw, a bracket, adhesive or the like may be provided.

In the example, each cutter module 10, 20 comprises an upper module half 104, 204 and a lower module half 106, 206 which clamp the respective transmission ring 102, 202. Handle-like extensions 108, 110, 208, 210 are provided at the upper and lower module halves 104, 204, 106, 206 to be grabbed and pressed against each other to pivot the upper and lower module halves relative to each other to disengage the module halves from the transmission rings and unlatch the respective cutter modules 10, 20 from the transmission rings 102, 202, as described in further detail with regard to FIGS. 9A and 9B below. Accordingly, each cutter module 10, 20 can be replaced by pressing together the-handle-like extensions 108, 110, 208, 210, unlatching the cutter modules 10, 20 from the transmission rings 102, 202 and inserting a cutter module by the reverse operation.

In the example illustrated, each of the cutter modules 10, 20, in its lower module half, comprises an upper rotary cutting blade and a lower rotary cutting blade wherein the lower rotary cutter blade 114, 214 is illustrated in the drawings; see FIGS. 7 and 9. The respective upper rotary cutting blades are movable cutting blades which are driven to rotate by rotation of the shaft 30, via a respective transmission group provided in lower module half of the respective cutter module 10, 20. Each transmission group may have an adjustable transmission ratio. In the example, the lower rotary cutting blade may be in contact with the upper rotary cutting blade to be friction-driven by the upper rotary cutting blade and to cut a print medium there between. In another example, instead of providing a lower rotary cutting blade, a lower stationery blade may be provided, such as a knife like linear blade, which interacts with the upper rotary cutting blade to cut a print medium there between. In another example, the upper rotary cutting blade may interact with a counter surface, instead of a lower cutting blade, to cut the print medium transported across the counter surface.

In the examples, each of the cutter modules 10, 20 comprises a gap 216 to guide a print medium there between and towards the associated cutting blades. Gap 1 is shown for the right-hand cutter module in FIGS. 9A and 9B.

As indicated above, within each cutter module 10, 20, a transmission group is provided between the shaft 30 and the upper rotary blade. The transmission group can be designed to achieve a desired transmission ratio. By controlling the rotation speed of the shaft 30 and adjusting the transmission ratio, the upper rotary blade can be rotated at a plurality of desired discrete rotation speeds or over a range of rotation speeds so as to cut print media at varying speeds. For example, the circumferential speed of the upper rotary blade can be the same as or higher than the speed at which the print medium is transported in the media advance direction A. Moreover, the rotation speed of the upper rotary blade can be adjusted according to the type of print medium, such as the thickness and/or rigidity of the print medium. For example, for a thicker and/or harder print medium a higher cutting speed may be selected then for a thinner and/or softer print medium.

The transmission group can be designed to transmit shaft rotation in one direction and to block rotation in the other direction. For example, if the shaft 30 rotates in the counterclockwise direction, rotation will be transmitted by the transmission group to the upper rotary blade which will be driven to rotate in the clockwise direction to cut a print medium which enters the gap 116. If, however, the shaft 30 rotates in the clockwise direction, the transmission group will lock and rotation of the shaft 30 will pivot the entire cutter module from a cutting position shown in FIG. 4 into a tilted or disengaging position, where the cutter module is moved out of the plane of print platen and retractable ribs. The cutter modules 10, 20 may be pivoted around the shaft 30 e.g. in a range of 45° to 180° from the cutting position shown in the drawings to the disengaged position which may be a standby position.

Each cutter module 10, 20 may be engaged with a positioner, wherein a right hand positioner 68, associated with the right hand cutter module 10, is shown in FIGS. 3 and 4. A respective left hand positioner can be associated with the left hand cutter module 20. Each positioner can be connected with its dedicated pulley drive and belt 12, 14; 22, 24 so that, when the respective cutter module 10, 20 is engaged with the positioner, the positioner can drag the cutter module the scanning direction X, bidirectionally, along the shaft 30 to position the cutter module at desired cutting positions.

One or both of the cutter modules 10, 20 may be replaceable modules. As indicated above, the handle like extensions 108, 110, 208, 210 of the upper and lower module halves 104, 204 can be grabbed and pressed against each other to pivot the upper and lower module halves 108, 110, 208, 210 relative to each other to disengage the module halves and unlatch the respective cutter modules 10, 20 from the transmission rings 102, 202. When a cutter module 10, 20 is replaced or first time inserted, a user can rely on certain features which guide the user to arrange a respective cutter module on a dedicated one of the transmission rings, i.e. in this example, arrange a left-hand cutter module on a left-hand transmission ring and a right-hand cutter module on a right-hand transmission ring. More specifically, a user can rely on at least one registration feature provided on one or both of a cutter module and its associated transmission ring.

Various features for helping the user to correctly engage a cutter module with its associated transmission ring are explained and illustrated with reference to FIG. 5 to 9. FIG. 5 shows a top view of part of a cutter arrangement, including the shaft 30, a left-hand cutter module 10, and a right-hand cutter module 20 which are arranged on the shaft 30 by respective transmission rings 102, 202. The transmission rings 102, 202 basically can be identical but will be mounted in different orientations for the left-hand cutter module 20 and the right-hand cutter module 10. In this example, the transmission rings 102, 202, have stepped diameters with the smallest diameter sections facing away from each other and with larger diameter sections facing towards each other. Each cutter module 10, 20 comprises an upper module half 104, 204 and lower module half 106, 206. The upper and lower module halves are further illustrated in FIGS. 6, 7, and 9. An example of a right-hand transmission ring 102 is further illustrated in FIG. 8.

Accordingly, each of the transmission rings 102, 202 features a varying outer diameter along its axial length, as explained for the right-hand transmission ring 102 with reference to FIG. 8. Corresponding features are provided on the left-hand transmission ring 202 which may be a mirror version of the right-hand transmission ring 102. The transmission ring 102 comprises a first diameter section 102*a*, a second diameter section 102*b*, a third diameter section 102*c*, and a fourth diameter section 102*d*.

The first diameter section 102*a*, in this example, extends across the largest part of the axial length of the transmission ring 102, such as across about ½ to ⅘ of its axial length. The second diameter section 102*b* is adjacent to the first diameter section 102*a* and has a larger outer diameter than the first diameter section 102*a* so that a step is formed therebetween. The third diameter section 102*c* again has a larger outer diameter than the second diameter section 102*b* and is adjacent to the second diameter section 102*b*, opposite to the first diameter section 102*a*. In this example, the first and second diameter sections 102*a*, 102*b* each have constant outer diameters whereas the third diameter section 102*c* features an inclined surface relative to the second diameter section 102*b*, having an increasing outer diameter at increasing distance from the second diameter section 102*b* to form a wedge like circumferential protrusion. The fourth diameter section 102*d* is adjacent to the third diameter section 102*c*, opposite to the second diameter section 102*b* and, in this example, is arranged at an end face of the transmission ring 102 opposite to the first diameter section 102*a*. In this example, the fourth diameter section 102*d* features an engagement ring having a number of blade or tooth like protrusions 102*e* for engagement with the upper module half, as explained further below.

The transmission ring 102 is hollow and, at its inner diameter, features a profile for engagement with the shaft 30 so as to be locked on the shaft 34 to rotate with the shaft. As indicated above, the left-hand transmission ring 202 may be a mirror version of the right-hand transmission ring 102.

The varying outer diameter profile of the transmission ring 102 provides registration features mating with corresponding registration features provided in the upper module half 104. Corresponding features are provided also in the left-hand transmission ring 202 and upper module half 204. Whereas, the various drawings may refer to the right-hand cutter module 10 or the left-hand cutter module 20, corresponding features also can be provided in the respective other module, without being explicitly said so in each individual case.

Figure 9A:
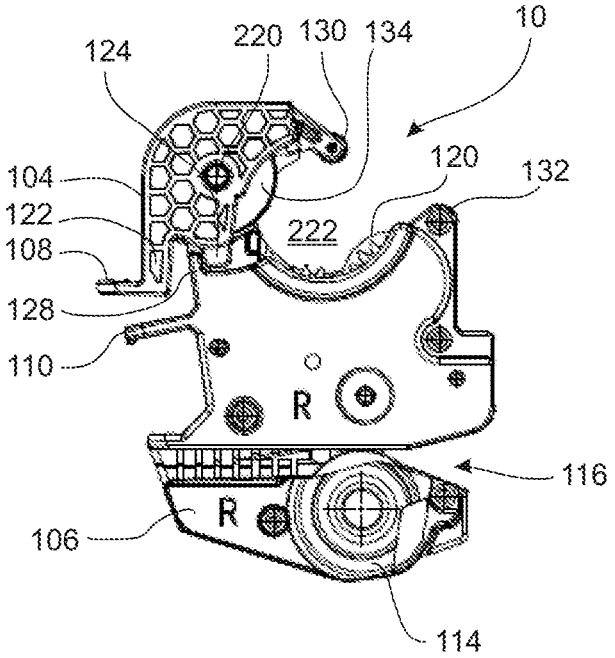
FIG. 9A shows a side view of a cutter module in a latching position, according to an example.
Figure 9B:
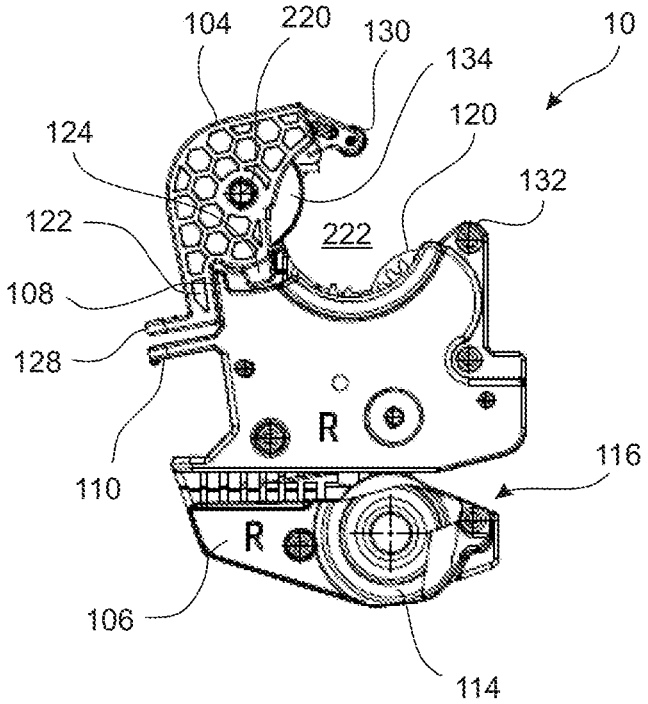
FIG. 9B shows a side view of the cutter module of FIG. 9A in an unlatching position, according to an example.

As illustrated in FIGS. 9A and 9B, the upper half 104 and the lower half 106 of the cutter module 10 are pivotally linked at a pivoting axis 220 and are movable relative to each other to open and close a clamping space 222 of the module 10 for unlatching and latching the cutter module from/to the transmission ring. The lower module half 106 comprises a first gear of the transmission group including a cylindrical body 120 which engages with the surface of the transmission ring 102 to transmit rotation of the shaft 30 and the transmission ring 102 to the first gear, when the cutter module is latched in the transmission ring. Accordingly, rotation of the shaft 30 is transmitted to the upper rotary blade by the transmission ring 102, 202 and the transmission group within the lower half 106, 206 of the cutter modules.

The upper module half 104 and the lower module half 106 comprise pinch rollers 130, 230, 132, 232 engaging the upper and lower module halves 104, 106 with the transmission ring in a low friction engagement. The upper module half 104 further comprises lateral edge wheels 134 that maintain the cutter module on the transmission ring during movement of the module in the X direction and positioning.

The upper module half 104 comprises a leg 122 and a stud 124 which interact with a respective stop 128 on the lower module half 106 to limit the movement range of the upper module half 104 relative to the lower module half 106 between the closed and the open positions, as shown in FIGS. 9A and 9B.

The upper module half 104, 204 further is designed in such a way that it comprises a transmission ring engagement section 104E, 204E and a registration section 104R, 204R. The transmission ring engagement section 104E includes the pinch roller 130, 230 and the lateral edge wheels 134 and is designed such that, when the cutter module is arranged on the transmission ring 102 and latched, the transmission ring engagement section 104E is in engagement with the first diameter section 102*a* of the transmission ring 102. Accordingly, the lower module half 106 and the transmission ring engagement section 104E of the upper module half 104 define an inner clamping space 222 which, when the module halves are in the closed position, has an inner dimension which corresponds to the outer diameter of the first diameter section 102*a* of the transmission ring. The inner dimension of the inner clamping space 222 is smaller than, for example, the outer diameter of the second diameter section 102*b* so that the cutter module, with its clamping space 222, will fit on the first diameter section 102*a* but not on the second diameter section 102*b* of the transmission ring. In one example, the inner dimension of the inner clamping space 222 can be defined by the smallest distance between the pinch rollers 130, 132, or between the pinch roller 130 and the cylindrical body 120.

Further, by limiting the relative pivoting movement of the upper and lower module halves 104, 106, when in the open position shown in FIG. 9B, the distance between the two pinch rollers one 130, 132 would be sufficient to allow insertion of the first diameter section 102*a* but not of the second or third or fourth diameter sections 102*b-d* of the transmission ring 102. This ensures that each cutter module is correctly positioned on the associated transmission ring. Accordingly, the corresponding inner and outer dimensions of the clamping space 222 and of the first diameter section of the transmission ring can be considered to form mating registration features.

A further registration feature is illustrated in FIGS. 5, 6B, and 6C. Adjacent to the transmission ring engagement section 104E, 204E the registration section 104R, 104R of the upper module half is located, the registration section 104R, 204R comprising a V-shaped groove 140, 240 which is designed to receive the wedge like third diameter section 102*c* of the transmission ring. Accordingly, the wedge-shaped protrusion of the third diameter section, in combination with the V-shaped groove form another registration feature which ensures that each cutter module is correctly positioned on its associated transmission ring. Cross-sections of the third diameter section of the transmission ring and the groove may be different from those shown. In a variant, the upper module half in the registration section comprises a protrusion and the transmission ring comprises a corresponding recess.

A further registration feature is formed by the combination of the fourth diameter section 102*d* carrying the blade or tooth like protrusions 102*e* and a stud 142 on the upper module half 104 which is designed to be inserted between two adjacent protrusions 102*e* when the cutter module is mounted on its associated transmission ring.

Still a further registration feature can be provided by a contour line 144, 244 provided on an outside of the upper module half 104, 204, the contour line 144, 244 visualizing the contour of the associated transmission ring 102, 202 to provide a visual feedback to a user inserting the cutter module 10, 20 to guide the user to arrange the cutter module on the dedicated transmission ring. As another type of visualization, color coding may be used. For example, the transmission ring can be provided with different colors along its length and the respective colors can be visualized on the outside of the associated upper module half.

As illustrated in FIG. 6D, the upper module half further may comprise a spring 146 or other biasing mechanism which keeps the cutter module correctly positioned and mounted on the associated transmission ring. The spring 146 counteracts the pivoting movement between the upper and lower module halves to open the inner clamping space and keeps the module halves closed and latched around the respective transmission ring, unless a user presses together the handle portions 108, 110 to open the module halves against the force of the spring, as shown in FIG. 9B.

The various registration features can be provided individually or in any combination thereof. They allow a user to easily and unmistakably handle, reinsert or exchange cutter modules in a printer. Cutter modules may be handled when there is a paper jam or when one cutter module should be exchanged by a new one. The registration features are such that the cutter modules become customer self-replaceable.

Figure 10:
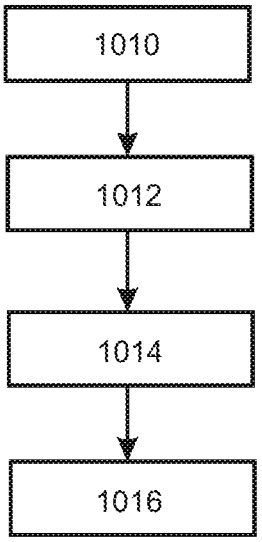
FIG. 10 shows a flow diagram illustrating an example of a process of latching a cutter module.

FIG. 10 shows a flow diagram illustrating an example of a process of latching a cutter module on a shaft. At 1010, a user grabs the two handle-like extensions of a cutter module and pressed them together to pivot the two module halves relative to each other to enlarge an inner clamping space, as shown in FIG. 9B. At 1012, the cutter module is aligned relative to the shaft using at least one of the registration features associated with at least one of the cutter module and the shaft, the registration feature providing feedback to the user to arrange the cutter module at a dedicated position along the length of the shaft and to align the cutter module relative to its dedicated transmission ring. At 1014, the cutter module is arranged on the shaft and, more specifically, on its dedicated transmission ring, with the transmission ring extending through the inner clamping space 222. The alignment is guided by the registration feature(s) to ensure that the correct cutter module is mounted on its associated transmission ring. At 1016, the two module halves are pivoted relative to each other to close the inner clamping space 222, as shown in FIG. 9A, and latch the cutter module on the associated transmission ring and hence on the shaft. The cutter module is secured on its associated transmission ring via the pinch rollers 130, 132, the cylindrical body 120 and the lateral edge roller 134 and the spring 146, among others.

Drive of the print media advance system (not shown), the shaft 30 and pulley drives 12, 22 and of the cutter modules 10, 20 as well as other entities of the printer and an associated cutting equipment may be controlled by a controller (not shown). The controller can be a microcontroller, ASIC, or other control device, including control devices operating based on hardware or a combination of hardware and software. It can include an integrated memory or communicate with an external memory or both. The same controller or separate controllers may be provided for controlling carriage movement, media advance and the rotary actuator. Different parts of the controller may be located internally or externally to a printer or separate cutting device, in a concentrated or distributed environment.

The invention claimed is:

1. A cutter arrangement for media processing equipment, comprising:

a cutter module to be arranged on a shaft via a dedicated transmission device, the cutter module and the dedicated transmission device comprising a registration feature to guide a user to arrange the cutter module on the dedicated transmission device;

wherein registration feature comprises complementary geometries of the cutter module and the dedicated one of the transmission devices.

2. The cutter arrangement of claim 1, further comprising a number of transmission devices, each transmission device including a transmission ring, wherein the dedicated transmission device is one of the number of transmission devices.

3. The cutter arrangement of claim 2, wherein the registration feature includes a varying outer diameter along an axial length of the transmission ring of the dedicated transmission device.

4. The cutter arrangement of claim 3, wherein the registration feature includes a respective varying inner dimension of an inner clamping space the cutter module.

5. The cutter arrangement of claim 2, wherein the registration feature includes a circumferential protrusion along an axial length the transmission ring of the dedicated transmission device and a recess provided on the cutter module and mating with the protrusion.

6. The cutter arrangement of claim 2, wherein the registration feature includes a circumferential recess along an axial length of the transmission ring of the dedicated transmission device and a protrusion provided on the cutter module and mating with the recess.

7. The cutter arrangement of claim 2, wherein the registration feature includes a visual feedback feature, illustrating on the cutter module a contour of the dedicated one of the transmission rings to prompt alignment of the cutter module relative to its dedicated transmission ring.

8. The cutter arrangement of claim 1, wherein the cutter module includes an upper half and a lower half, the lower half carrying a cutter blade and the upper half including the registration feature.

9. The cutter arrangement of claim 8, wherein the upper half and the lower half of the cutter module are pivotally linked at a pivoting axis and are movable relative to each other to latch and unlatch the upper and lower halves of the cutter module around the transmission device.

10. The cutter arrangement of claim 9, wherein pivoting movement of the upper and lower halves of the cutter module is limited by a stop.

11. A printer comprising:

a shaft extending in a direction perpendicular to a media advance direction of the printer; and a cutter module slidably arranged on the shaft via a transmission ring;

wherein the cutter module and the transmission ring include mating registration features to guide a user to arrange the cutter module on the transmission ring.

12. The printer of claim 11, wherein two transmission rings are arranged on the shaft, each transmission ring including a registration feature different from the registration feature of the respective other transmission ring, and further including two cutter modules, the two cutter modules including respective registration features mating with different ones of the registration features of the transmission rings.

13. The printer of claim 12, wherein the registration features include at least one of:

a visual feedback, illustrating on each of the cutter modules a contour of the dedicated one of the transmission rings to prompt alignment of the cutter module relative to its dedicated transmission ring; and complementary geometries of an inner clamping space of each one of the cutter modules and of an outer periphery of the respective mating transmission rings.

14. A method of installing a cutter module on a shaft, wherein the cutter module comprises two module halves pivotally connected to each other, the method comprising:

pivoting the two module halves relative to each other to enlarge an inner clamping space;

aligning the cutter module relative to the shaft using a registration feature associated with at least one of the cutter module and the shaft, the registration feature providing feedback to a user to arrange the cutter module at a dedicated position along the length of the shaft;

arranging the cutter module on the shaft, with the shaft extending through the inner clamping space; and pivoting the two module halves relative to each other to reduce the inner clamping space and latch the cutter module on the shaft.

15. The cutter arrangement of claim 1, wherein the cutter module comprises left and right cutters which are independently slidable along the shaft extending perpendicular to a media advance direction.

16. The cutter arrangement of claim 15, wherein the transmission device comprises a transmission ring for each cutter, each transmission ring to couple a respective cutter to the shaft, wherein rotation of the shaft drives the cutter via the respective transmission ring, each transmission ring having a registration feature to guide engagement with one of the cutters.

17. The cutter arrangement of claim 16, wherein the registration features on the transmission rings comprise varying diameters with steps of different diameter.

18. The cutter arrangement of claim 16, wherein the registration features on the transmission rings comprise different colors along a length of each transmission ring.

19. The cutter arrangement of claim 15, wherein each cutter has an upper and lower half that are pivoted with relative to each other to release the cutter from the shaft.

* * * * *